US009764571B2

(12) United States Patent
Mueller et al.

(10) Patent No.: US 9,764,571 B2
(45) Date of Patent: Sep. 19, 2017

(54) DEVICE FOR FEEDING SHEETS AND DIGITAL SHEET-FED PRINTING MACHINE HAVING THE DEVICE

(71) Applicant: HEIDELBERGER DRUCKMASCHINEN AG, Heidelberg (DE)

(72) Inventors: Andreas Mueller, Heidelberg (DE); Burkhard Wolf, Dossenheim (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 14/844,527

(22) Filed: Sep. 3, 2015

(65) Prior Publication Data

US 2016/0082755 A1 Mar. 24, 2016

(30) Foreign Application Priority Data

Sep. 23, 2014 (DE) ..... 10 2014 219 146

(51) Int. Cl.
*B41J 13/22* (2006.01)
*B65H 3/44* (2006.01)
*B65H 5/12* (2006.01)

(52) U.S. Cl.
CPC ..... *B41J 13/226* (2013.01); *B65H 3/44* (2013.01); *B65H 5/12* (2013.01); *B65H 2406/345* (2013.01); *B65H 2801/21* (2013.01)

(58) Field of Classification Search
CPC ..... B41J 13/226; B41J 13/22; B41J 13/223; B41J 15/18; B41J 15/22; B41J 15/24; B41J 15/14; B65H 5/12; B65H 5/14; B65H 5/085; B65H 5/08; B65H 2406/34; B65H 2404/6582; B65H 2301/4482; B65H 2301/44822
USPC ..... 347/104, 101; 198/803.3, 803.5, 803.9, 198/803.1; 271/82, 85, 206, 307
See application file for complete search history.

(56) References Cited

U.S. PATENT DOCUMENTS

| | | | | |
|---|---|---|---|---|
| 4,378,734 | A * | 4/1983 | Wirz | B65H 5/12 101/230 |
| 4,458,893 | A | 7/1984 | Ruh | |
| 5,308,056 | A * | 5/1994 | Achelpohl | B31B 19/98 271/183 |
| 6,298,778 | B1 * | 10/2001 | Onodera | B41L 21/02 101/116 |
| 6,851,361 | B2 * | 2/2005 | Gorbing | B41F 21/106 101/230 |
| 7,516,952 | B2 | 4/2009 | Bittner et al. | |
| 2012/0092431 | A1 * | 4/2012 | Hara | B41J 13/223 347/104 |

FOREIGN PATENT DOCUMENTS

| | | | |
|---|---|---|---|
| DE | 3138540 | A1 | 4/1983 |
| DE | 102004012694 | A1 | 10/2005 |

* cited by examiner

*Primary Examiner* — Henok Legesse
(74) *Attorney, Agent, or Firm* — Laurence A. Greenberg; Werner H. Stemer; Ralph E. Locher

(57) ABSTRACT

A device for feeding sheets to a digital sheet-processing machine includes a feed drum for transporting the sheets to the printing machine. At least two transport paths are provided to convey the sheets to be processed to the feed cylinder in at least two different positions from where the sheets are taken over by a gripper device of the feed cylinder and accelerated to processing speed. A digital sheet-fed printing machine having the device is also provided.

13 Claims, 5 Drawing Sheets

DEVICE FOR FEEDING SHEETS AND DIGITAL SHEET-FED PRINTING MACHINE HAVING THE DEVICE

CROSS-REFERENCE TO RELATED APPLICATION

This application claims the priority, under 35 U.S.C. §119, of German Patent Application DE 10 2014 219 146.7, filed Sep. 23, 2014; the prior application is herewith incorporated by reference in its entirety.

BACKGROUND OF THE INVENTION

Field of the Invention

The invention relates to a device for feeding sheets to a sheet-processing machine, in particular a digital printing machine, by using a revolving feed drum having a drive that is controllable separately from a printing machine.

German Patent Application DE 31 38 540 A1, corresponding to U.S. Pat. No. 4,458,893, discloses a feed drum that takes over an aligned sheet at a standstill by using gripper devices, accelerates the sheet to machine speed, and transfers the sheet to a cylinder of the offset printing press. However, sheets from only one feed path may be processed.

SUMMARY OF THE INVENTION

It is accordingly an object of the invention to provide a device for feeding sheets and a digital sheet-fed printing machine having the device, which overcome the hereinafore-mentioned disadvantages of the heretofore-known devices and printing machines of this general type and in which sheets from at least two different feed paths may be processed.

With the foregoing and other objects in view there is provided, in accordance with the invention, a device for feeding sheets to a sheet-processing machine, comprising a revolving feed drum having a drive controllable separately from a drive of the sheet-processing machine.

A particular advantage of the invention is that the gripper device of the feed drum is capable of taking over sheets in at least two different positions. Due to this feature, sheets of different format lengths may be processed even in an alternating way, for instance.

It is advantageously likewise possible for sheets that have already been printed on a first side to be fed back to the feed cylinder in order to be printed on a second side.

The number of feed paths determines the flexibility of the processing machine.

In accordance with another preferred feature of the invention, the gripper devices of the feed drum are embodied as suction grippers.

Activation of the suction air is freely controllable, allowing the suction grippers to be activatable in any desired cylinder position.

With the objects of the invention in view, there is concomitantly provided a digital sheet-fed printing machine, comprising the device according to the invention.

Other features which are considered as characteristic for the invention are set forth in the appended claims.

Although the invention is illustrated and described herein as embodied in a device for feeding sheets and a digital sheet-fed printing machine having the device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
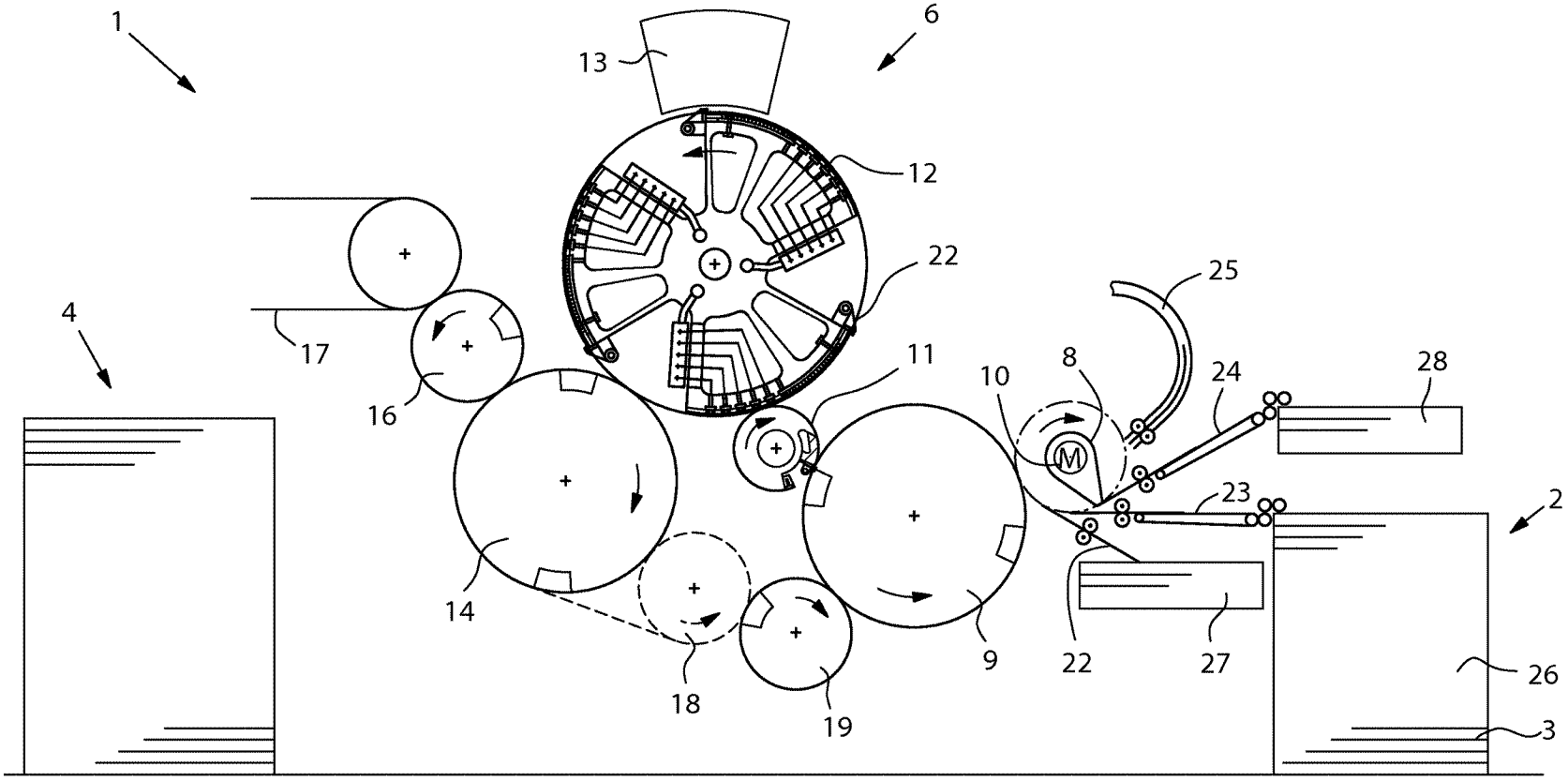
FIG. 1 is a diagrammatic, longitudinal-sectional view of a digital printing machine.

Referring now to the figures of the drawings in detail and first, particularly, to FIG. 1 thereof, there is seen a sheet-fed printing machine 1, in particular a digital printing machine, including a feeder 2 for feeding sheets to the sheet-fed printing machine 1 and a delivery 4 for removing the printed sheets from the digital printing machine 1. At least one printing unit or station 6 is provided to print the sheets 3. The sheets are transferred from the feeder 2 to a feed cylinder or drum 8 by using a feed table. The feed cylinder 8 preferably transfers the sheets to a double-size transfer drum 9. From there the sheets 3 travel to a triple-size printing cylinder 12, for instance, by using a single-size transfer cylinder 11. The sheets are printed on the printing cylinder 12 by an inkjet printing unit 13. The printed sheets 3 are transferred from the printing cylinder 12 to a transfer drum, in particular a double-size transfer drum 14, which transfers the sheets to a single-size transfer drum 16. The transfer drum 16 in turn transfers the sheets to a chain gripper 17 of the delivery 4. In a reversing mode, the transfer drum 14 operates as a storage drum and transfers the trailing edges of the sheets to a downstream reversing drum 18. From there, the sheets 3 are fed back to the transfer drum 9 by using a transfer drum 19 to be printed on their second sides in the printing unit 6.

Figure 2:
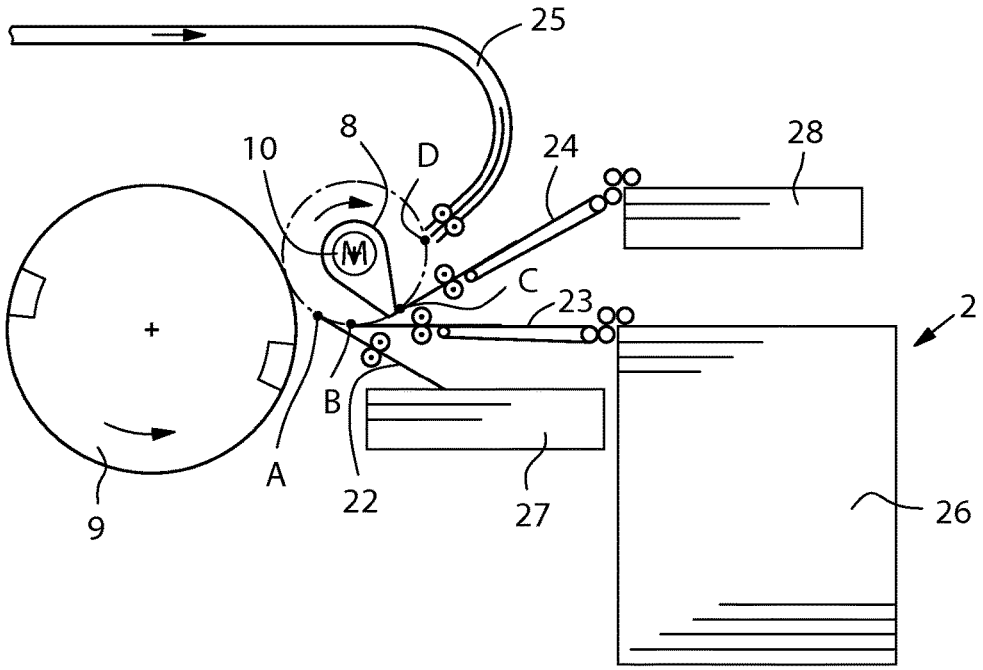
FIG. 2 is a longitudinal-sectional view of a feeder of the digital printing machine.
Figure 3:
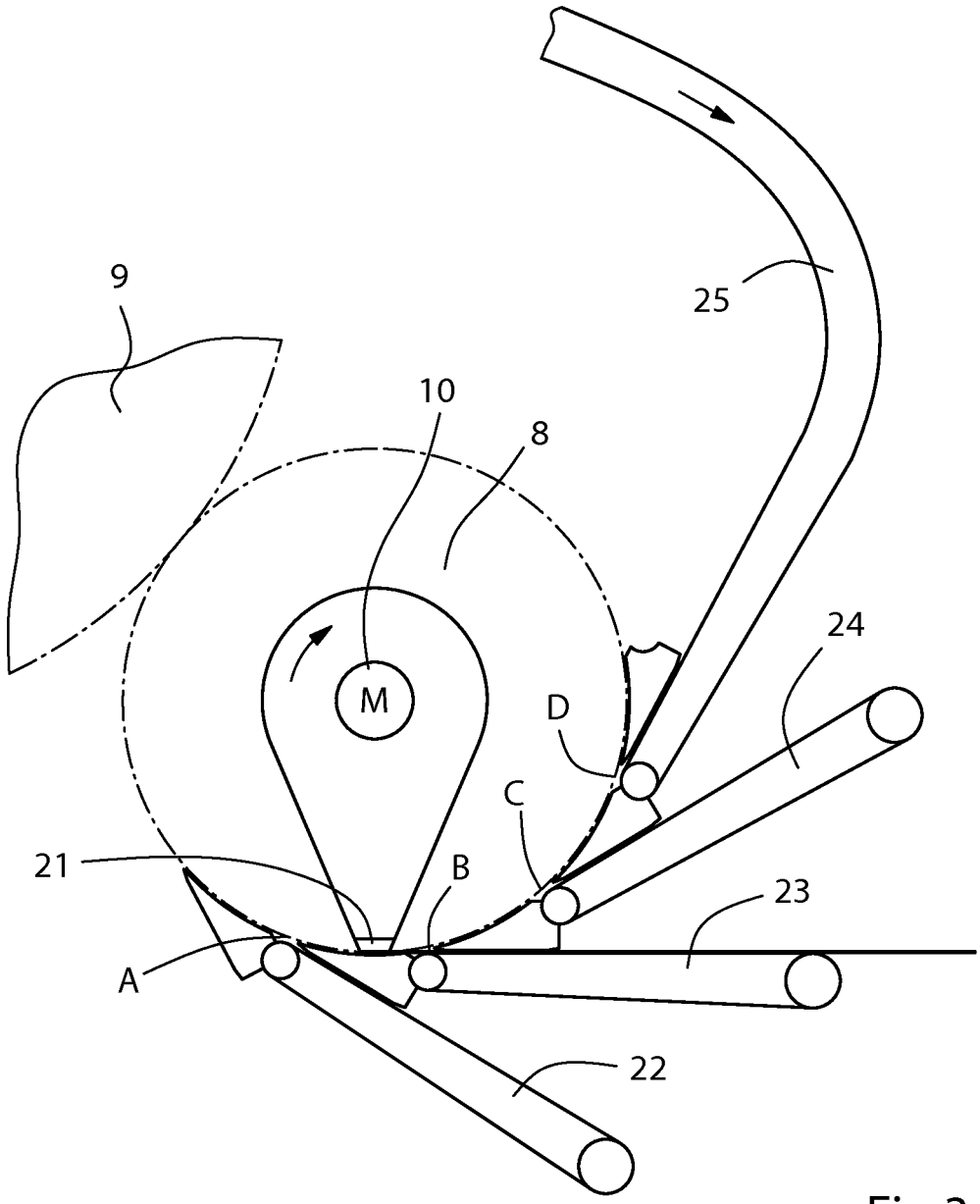
FIG. 3 is an enlarged, longitudinal-sectional view of a feed drum of the digital printing machine.

In the exemplary embodiment shown in FIG. 2, the feed drum 8 is drivable by a drive 10, for instance an electric motor, which is actuatable separately from the sheet-processing machine 1. At least two positions, preferably four positions A, B, C, D are provided in which a gripper device 21 of the feed drum 8 takes over sheets from a transport path 22; 23; 24; 25 at a minimum speed or at a standstill. Then the gripper device 21 accelerates the sheets to machine speed and transfers them to the downstream sheet transfer drum 9.

The transport path 23 takes sheets from a sheet stack 26. The transport path 22 receives sheets from a further sheet stack 27. The transport path 24 is supplied with sheets from a sheet stack 28. The sheets from the stack 28 may, for instance, have a shorter format length than the sheets in the stack 26. The transport path 25, for instance, conveys sheets that have already been printed on one side and are to be printed on a second side.

Due to the fact that the drive 10 of the feed drum 8 is actuatable independently of the drive of the printing machine, the feed drum may be positively or negatively accelerated relative to the printing machine 1. This is done, for instance, when sheets of the transport path 24, which is farther removed from the location of sheet transfer between the feed drum 8 and the sheet transfer drum 9 than the transport path 23 in position C, for instance, are processed in position B.

Figure 4:
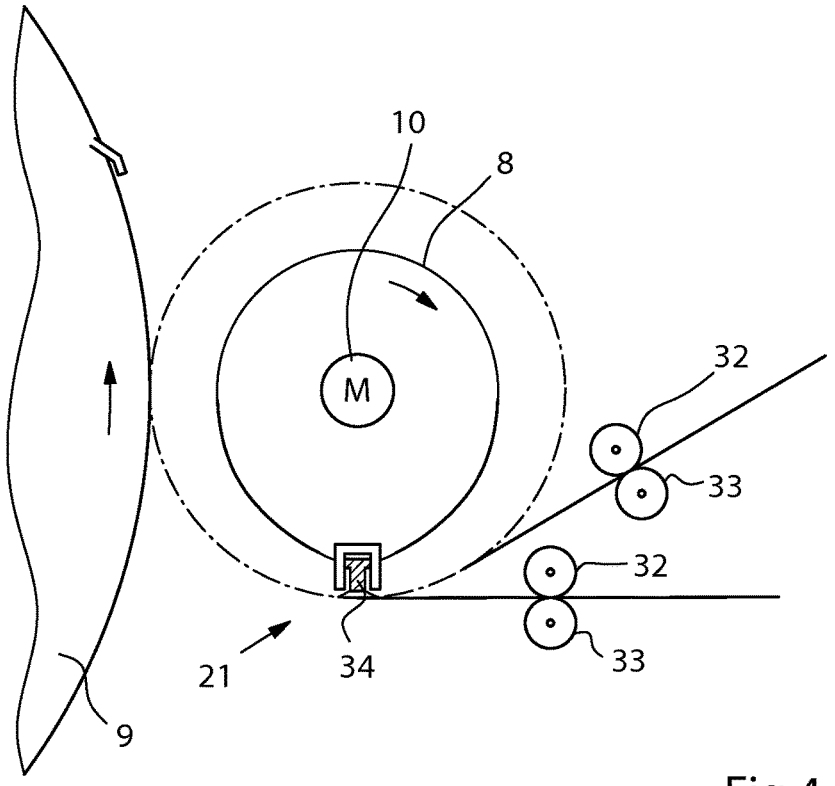
FIG. 4 is a longitudinal-sectional view of the feed drum including suction grippers.

An end of every transport path 22 to 25 facing the feed drum 8 has a drivable pair of transport rollers 32, 33, which guide the respective sheet to a periphery defined by the rotating gripper device 21 in order for the sheet to be taken over by the gripper device 21 which is embodied as a suction gripper 34. The suction gripper 34 is preferably embodied as a spring sucker as shown in FIG. 4.

Figure 5:
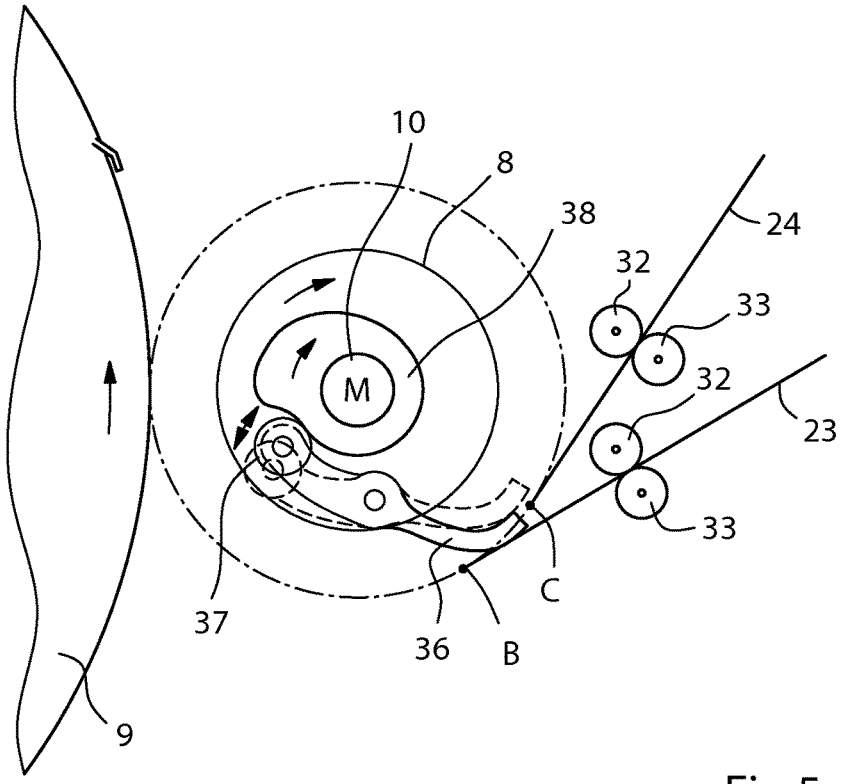
FIG. 5 is a longitudinal-sectional view of a second exemplary embodiment of the feed drum of the invention including a pivotable gripper device.

In an exemplary embodiment shown in FIG. 5, the gripper device 21 is embodied as a pivotable suction gripper 36 disposed to pivot by using a cam mechanism 37, 38.

The suction gripper 36 is supported to pivot out of the interior towards the periphery of the feed drum 8 to take over the sheet in a position A, B, C, D.

A control cam 38 of the cam mechanism 37, 38 is supported for rotation and determines the instant of the pivoting movement as a function of the rotational position.

Due to this feature, sheets may be taken over from transport paths 21 to 25 in different positions A, B, C, D.

Figure 7:
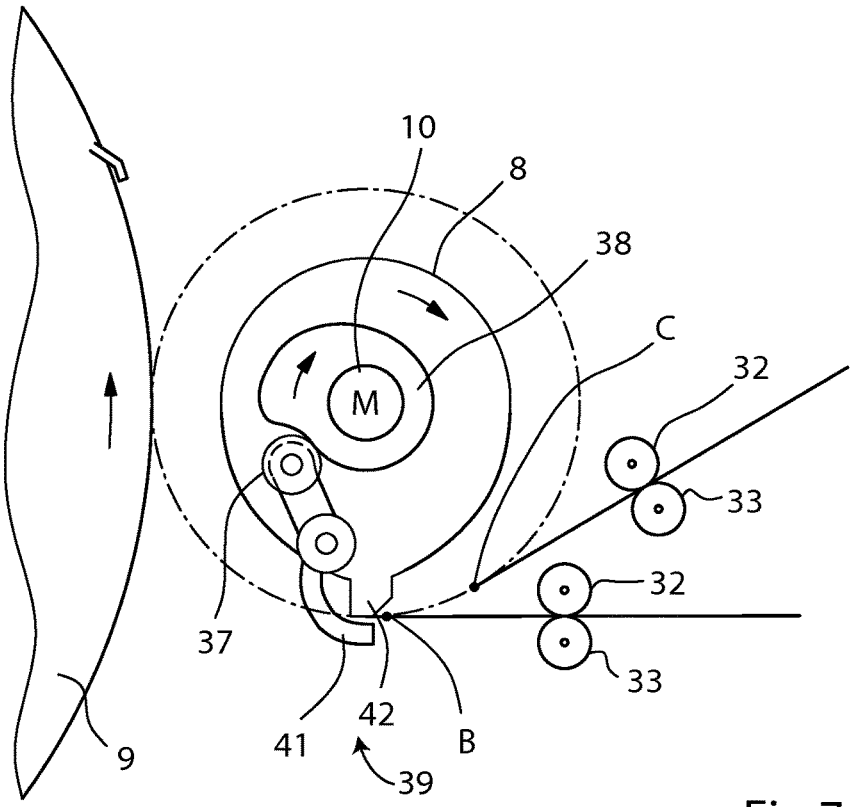
FIG. 7 is a longitudinal-sectional view of the feed drum including mechanical grippers.

In an exemplary embodiment shown in FIG. 7, the gripper device 21 is embodied as a mechanical gripper 39 actuatable by the cam mechanism 37, 38. The gripper 39 includes a gripper finger 41 and a gripper pad 42 interacting with the gripper finger 41.

Figure 6:
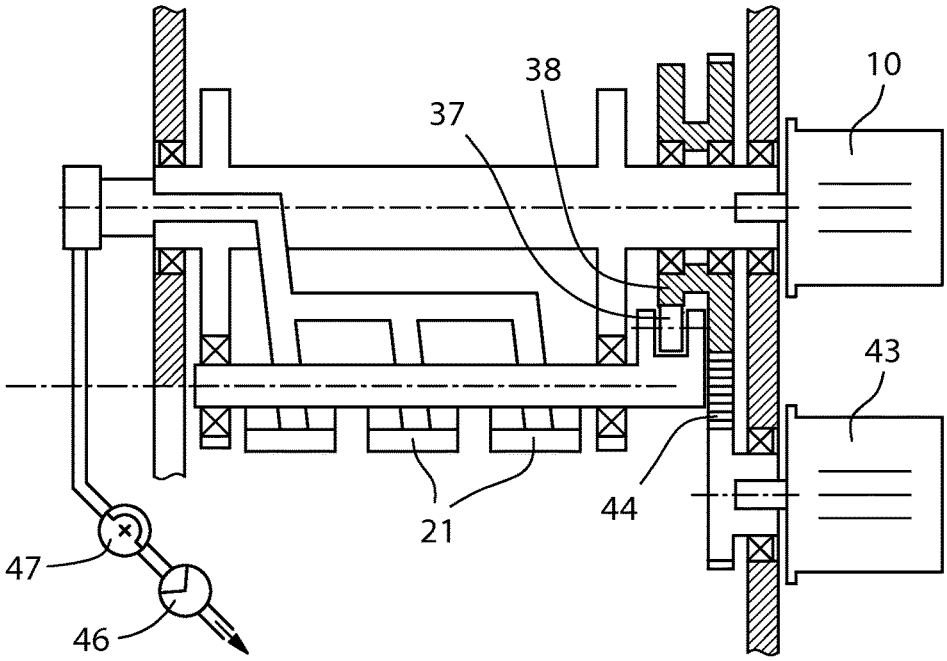
FIG. 6 is an elevational view of the feed drum shown in FIG. 4.

As shown in FIG. 6, the control cam 38 is adjusted by a drive motor 43 through a belt 44. A rotary valve 47 connected to a vacuum source 46 controls the suction air of the suction grippers 21; 34, 36 as a function of the positions A to D of the transport paths 22 to 25 to be used. Alternatively, the suction air may be controlled by remote-controlled solenoid valves.

The exemplary embodiment is a digital printing machine with a cylinder-based conveying system. Alternatively, a belt or tray-based conveying system may be provided and the sheets may be transferred from the feed drum to a conveyor belt or tray.

The invention claimed is:

1. A device for feeding sheets to a printing cylinder of a printing machine, the sheets being printed on the printing cylinder, the device comprising:

a revolving feed drum having a circumference, at least two sheet take over positions adjacent said feed drum offset along said circumference, and said feed drum having a drive for revolving said feed drum controllable separately from a drive of the printing cylinder of the printing machine; and transport paths feeding sheets to said feed drum, said transport paths disposed for respectively delivering sheets to said at least two sheet take over positions;

said feed drum having a gripper device configured to take over sheets in said at least two sheet take over positions.

2. The device according to claim 1, wherein said gripper device is constructed as a suction gripper.

3. The device according to claim 2, wherein said suction gripper is supported to pivot.

4. The device according to claim 3, which further comprises a cam mechanism for implementing pivoting movements of said suction grippers.

5. The device according to claim 4, wherein said cam mechanism has a control cam configured to rotate.

6. The device according to claim 5, which further comprises a drive motor configured to drive said control cam, said drive motor disposed separately from said drive of said feed drum.

7. The device according to claim 2, which further comprises a rotary valve controlling suction air for said suction grippers, said rotary valve being controllable as a function of said at least two sheet take over positions of a respective one of said transport paths selected to convey the sheets.

8. The device according to claim 1, wherein said gripper device has mechanically actuatable grippers.

9. The device according to claim 8, which further comprises a cam mechanism for implementing pivoting movements of said mechanically actuatable grippers.

10. The device according to claim 9, wherein said cam mechanism has a control cam configured to rotate.

11. The device according to claim 10, which further comprises a drive motor configured to drive said control cam, said drive motor disposed separately from said drive of said feed drum.

12. The device according to claim 1, which further comprises drivable pairs of transport rollers, each of said pairs of transport rollers being associated with a respective one of said transport paths.

13. A digital sheet-fed printing machine, comprising a device according to claim 1.

* * * * *